US009388991B2

(12) United States Patent
Phillips et al.

(10) Patent No.: US 9,388,991 B2
(45) Date of Patent: Jul. 12, 2016

(54) FLOW CONTROL DEVICE FOR AN OVEN

(75) Inventors: Bryan Thomas Phillips, Goodlettsville, TN (US); Denise Wyrick, Goodlettsville, TN (US); Vittorio Cascianelli, Huntersville, NC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 397 days.

(21) Appl. No.: 13/458,349

(22) Filed: Apr. 27, 2012

(65) Prior Publication Data

US 2012/0272946 A1 Nov. 1, 2012

Related U.S. Application Data

(60) Provisional application No. 61/479,528, filed on Apr. 27, 2011.

(51) Int. Cl.

| | |
|---|---|
| ***F24C 15/32*** | (2006.01) |
| ***F24C 15/20*** | (2006.01) |
| ***F24C 15/00*** | (2006.01) |

(52) U.S. Cl.

CPC ..... *F24C 15/2007* (2013.01); *F24C 15/001* (2013.01)

(58) Field of Classification Search

CPC .... A47J 37/0704; B29C 45/0001; F16K 1/16; F24C 15/2007; F24C 15/001

USPC ..... 126/21 R, 504, 292; 251/298; 454/333

See application file for complete search history.

(56) References Cited

U.S. PATENT DOCUMENTS

| | | | | | |
|---|---|---|---|---|---|
| 83,139 | A | * | 10/1868 | Deily | 126/292 |
| 3,500,812 | A | * | 3/1970 | Korngold | 126/25 R |
| 3,521,659 | A | * | 7/1970 | Seger | 137/112 |
| 3,817,490 | A | * | 6/1974 | Deeg | 251/58 |
| 3,865,193 | A | * | 2/1975 | Hall | 169/65 |
| 5,473,979 | A | * | 12/1995 | Ruben | 99/446 |
| 5,503,550 | A | * | 4/1996 | DePalma | 431/125 |
| 5,575,274 | A | * | 11/1996 | DePalma | 126/512 |
| 5,639,497 | A | * | 6/1997 | Bedford et al. | 426/233 |
| 5,647,399 | A | * | 7/1997 | Andersen | 137/637.3 |

(Continued)

FOREIGN PATENT DOCUMENTS

| | | |
|---|---|---|
| DE | 3040051 | 6/1982 |
| DE | 102006024658 | 11/2007 |

(Continued)

OTHER PUBLICATIONS

Partial International Search Report for PCT/US2012/35530, 2 pages.

*Primary Examiner* — Steven B McAllister
*Assistant Examiner* — Rabeeul Zuberi
(74) *Attorney, Agent, or Firm* — Pearne & Gordon LLP

(57) ABSTRACT

An oven is provided including an oven cavity and an outlet duct for receiving exhaust gas from the oven cavity. The oven further includes a flow control device attached to the outlet duct. The flow control device includes a damper assembly positioned at least partially within the outlet duct. The damper assembly is movable with respect to the outlet duct. The flow control device further includes a drive unit attached to the damper assembly, the drive unit selectively moving the damper assembly between a closed position in which the damper assembly blocks a flow of the exhaust gas through the outlet duct and an opened position. The oven further includes a control system for controlling the damper assembly.

12 Claims, 7 Drawing Sheets

(56) References Cited

U.S. PATENT DOCUMENTS

| | | | | |
|---|---|---|---|---|
| 5,706,796 | A * | 1/1998 | Genero | 126/21 R |
| 5,752,497 | A * | 5/1998 | Combs et al. | 126/25 R |
| 6,058,832 | A * | 5/2000 | Fountain | 99/446 |
| 6,201,225 | B1 * | 3/2001 | Lee | 219/757 |
| 6,373,039 | B2 * | 4/2002 | Lee | 219/757 |
| 6,433,323 | B2 * | 8/2002 | Kim | 219/757 |
| 7,863,549 | B2 * | 1/2011 | Song et al. | 219/757 |
| 8,371,286 | B2 * | 2/2013 | McCown | 126/289 |
| 2003/0000513 | A1 * | 1/2003 | Cole et al. | 126/21 A |
| 2003/0170578 | A1 * | 9/2003 | Weiss | 431/20 |
| 2007/0221191 | A1 * | 9/2007 | O'Brien et al. | 126/25 R |
| 2009/0009344 | A1 * | 1/2009 | Chian | 340/577 |
| 2010/0012048 | A1 * | 1/2010 | Whitford et al. | 122/14.21 |
| 2010/0258106 | A1 * | 10/2010 | Simms, II | 126/25 R |

FOREIGN PATENT DOCUMENTS

| | | | | |
|---|---|---|---|---|
| WO | 2009043779 | | 4/2009 | |
| WO | WO 2009043779 | A2 * | 4/2009 | F24C 15/20 |

* cited by examiner

FLOW CONTROL DEVICE FOR AN OVEN

CROSS-REFERENCE TO RELATED APPLICATIONS

This application claims priority to U.S. Provisional Application No. 61/479,528, filed Apr. 27, 2011 entitled "Smart Oven Vent," which application is hereby incorporated by reference in its entirety.

FIELD

The present invention relates generally to ovens and, more particularly, to ovens having outlet ducts for ducting exhaust air.

BACKGROUND

Ovens generally utilize a heating assembly to heat an interior of an oven cavity. The heating assembly remains on until an interior of the oven cavity reaches a set temperature. Once the oven cavity reaches the set temperature, the heating assembly will turn off. The heating assembly will remain off until a certain minimum temperature is reached within the oven cavity, whereupon the heating assembly will cycle back on to heat the cavity to the set temperature. During this on/off cycling of the heating assembly, exhaust air from the interior of the oven is continuously vented regardless of whether the heating assembly is on or off.

BRIEF SUMMARY

The following presents a simplified summary of the invention in order to provide a basic understanding of some example aspects. This summary is not an extensive overview. Moreover, this summary is not intended to identify critical elements nor delineate the scope of the invention. The sole purpose of the summary is to present some concepts in simplified form as a prelude to the more detailed description that is presented later.

In accordance with one aspect, an oven is provided including an oven cavity and an outlet duct in fluid communication with the oven cavity. The oven further includes a flow control device coupled to the outlet duct. The flow control device includes a damper assembly positioned at least partially within the outlet duct, the damper assembly being movable with respect to the outlet duct. The flow control device further includes a drive unit operatively coupled to the damper assembly, the drive unit being configured to selectively move the damper assembly between a closed position in which exhaust gas is blocked from flowing through the outlet duct and an opened position.

In accordance with another aspect, an oven is provided including an oven cavity including a heating assembly for heating the oven cavity. An outlet duct is in fluid communication with the oven cavity, the outlet duct receiving exhaust gas from the oven cavity. The oven further includes a flow control device attached to the outlet duct, the flow control device including a damper assembly positioned within the outlet duct. The damper assembly is movable with respect to the outlet duct between a closed position and an opened position. The flow control device further includes a control system configured to send signals to move the damper assembly to the opened position when the heating assembly is turned on, the control system further configured to send signals to move the damper assembly to the closed position when the heating assembly is turned off.

In accordance with another aspect, an oven is provided including an oven cavity having a heating assembly for heating the oven cavity. The oven further includes an outlet duct in fluid communication with the oven cavity, the outlet duct receiving exhaust gas from the oven cavity. A flow control device is attached to the outlet duct. The flow control device includes a damper assembly positioned within the outlet duct, the damper assembly being movable with respect to the outlet duct between a closed position and an opened position. The flow control device further includes a control system for sending signals to move the damper assembly to the opened position when the heating assembly is turned on, the control system further sending signals to move the damper assembly to the closed position when the heating assembly is turned off.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION

Figure 1:
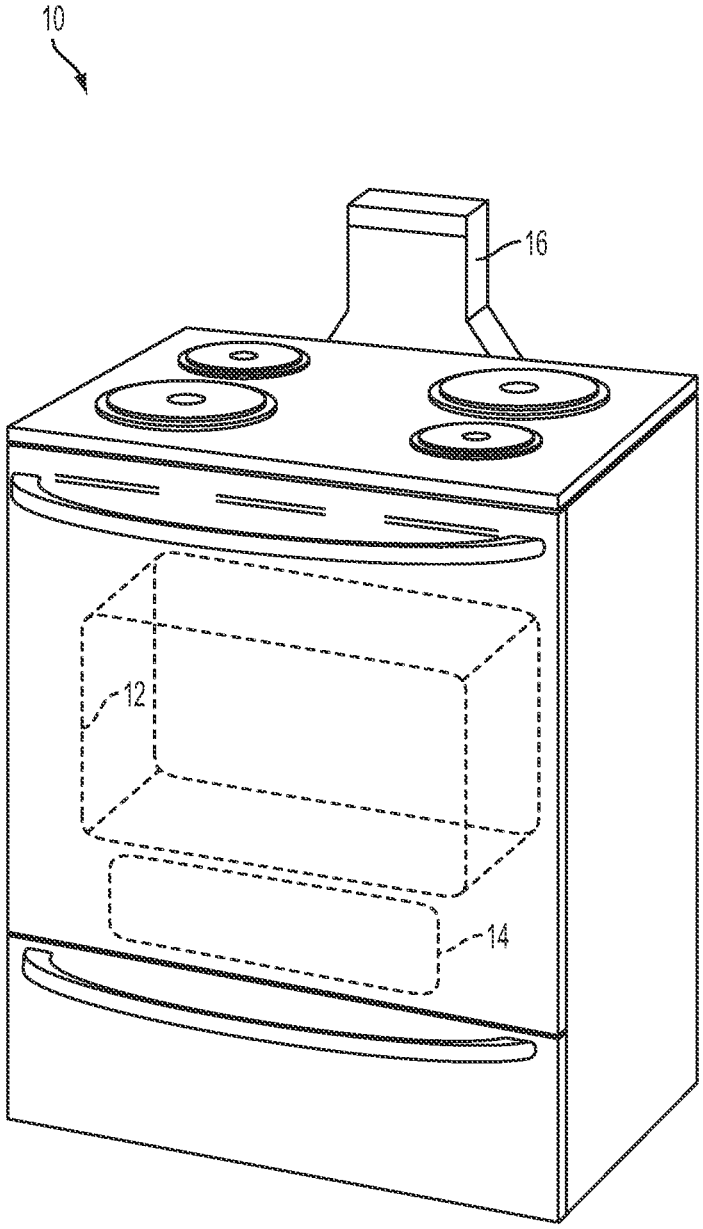
FIG. 1 is a perspective view of an oven including an outlet duct.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Referring to the example of FIG. 1, an example oven 10 is shown. The oven 10 includes an oven cavity 12 for heating and/or cooking food items. The oven cavity 12 is heated by a heating assembly 14. As will be described in detail below, the oven 10 includes a flow control device 22 for selectively allowing exhaust gas to exit from the oven cavity 12. By limiting the exit of exhaust gas from the oven cavity 12, oven efficiency can be increased.

It is to be appreciated that the oven 10 in FIG. 1 is somewhat generically/schematically shown, as the oven 10 can include any number of constructions. For example, the oven 10 includes a gas oven, an electric oven, freestanding ovens, built-in ovens, etc. Further, the oven 10 is not limited to the size and shape that is shown, as the oven 10 could be larger or smaller in size, and/or include more or less than the four burners positioned at an upper surface of the oven 10.

The oven cavity 12 is defined by a plurality of walls such that warm air within the oven cavity 12 is limited from escaping. An oven door is provided to allow for selective access to the oven cavity 12. The oven cavity 12 can be larger or smaller in size than as shown, and could include various cooking structures placed therein (e.g., racks, shelves, etc.). Further, the oven 10 is not limited to the single oven cavity shown in FIG. 1, and in further examples, could include a plurality of oven cavities, such as in a vertically or horizontally stacked orientation.

As with the oven 10 and oven cavity 12, the heating assembly 14 is also generically/schematically depicted for illustrative purposes. In particular, the heating assembly 14 includes any number of structures that can provide heat to the oven cavity 12. For example, the heating assembly 14 can include one or more gas burners. In another example, the heating assembly 14 could include one or more electric heaters, such as electric resistance heaters. Of course, it is to be understood that the heating assembly 14 can include other heating structures, and is not limited to those described herein, and could include steam heating, convection heating, or the like. In addition, while the heating assembly 14 is shown to be positioned near a bottom portion of the oven cavity 12, it is to be understood that the heating assembly 14 could be positioned at any suitable location, and could comprise a plurality of heating assemblies 14. For example, the heating assembly 14 could be positioned either or both near a bottom portion of and a top portion of the oven cavity 12. In an example in which the heating assembly 14 includes electric heaters, the electric heaters may be positioned within the oven cavity 12 at either or both the bottom portion or top portion.

The operation of the heating assembly 14 can now be briefly described. Initially, a user sets a temperature for the oven cavity 12, such as by using a user interface, controller, etc. Once the temperature is set, the heating assembly 14 turns on and remains on until the pre-set temperature is reached in the oven cavity 12. Once the pre-set temperature within the oven cavity 12 is reached, the heating assembly 14 turns off. The heating assembly 14 then cycles on and off as heat is needed to maintain the desired cooking temperature.

The oven 10 further includes an outlet duct 16. The outlet duct 16 is shown to be positioned at a rear of the oven 10 in FIG. 1, though, it is to be appreciated that the outlet duct 16 could be positioned at any number of locations. The outlet duct 16 defines a substantially hollow passageway through which exhaust gas from the oven cavity 12 can exit. In particular, the outlet duct 16 is in fluid communication with the oven cavity 12 such that exhaust gas passes from the oven cavity 12, through the outlet duct 16, and into the environment outside of the oven. The exhaust gas can include, but is not limited to, byproducts of the baking process, self-cleaning cycle, or the like. The outlet duct 16 is shown generically in FIG. 1, as the outlet duct 16 can include a variety of sizes, shapes and configurations. As such, it is to be appreciated that the outlet duct 16 shown herein comprises only one possible example outlet duct, as a number of constructions are envisioned. As will be described in more detail below, the outlet duct 16 can be selectively opened and closed, so as to allow or restrict, respectively, the passage of the exhaust gas from the oven cavity 12 and through the outlet duct 16.

Figure 2:
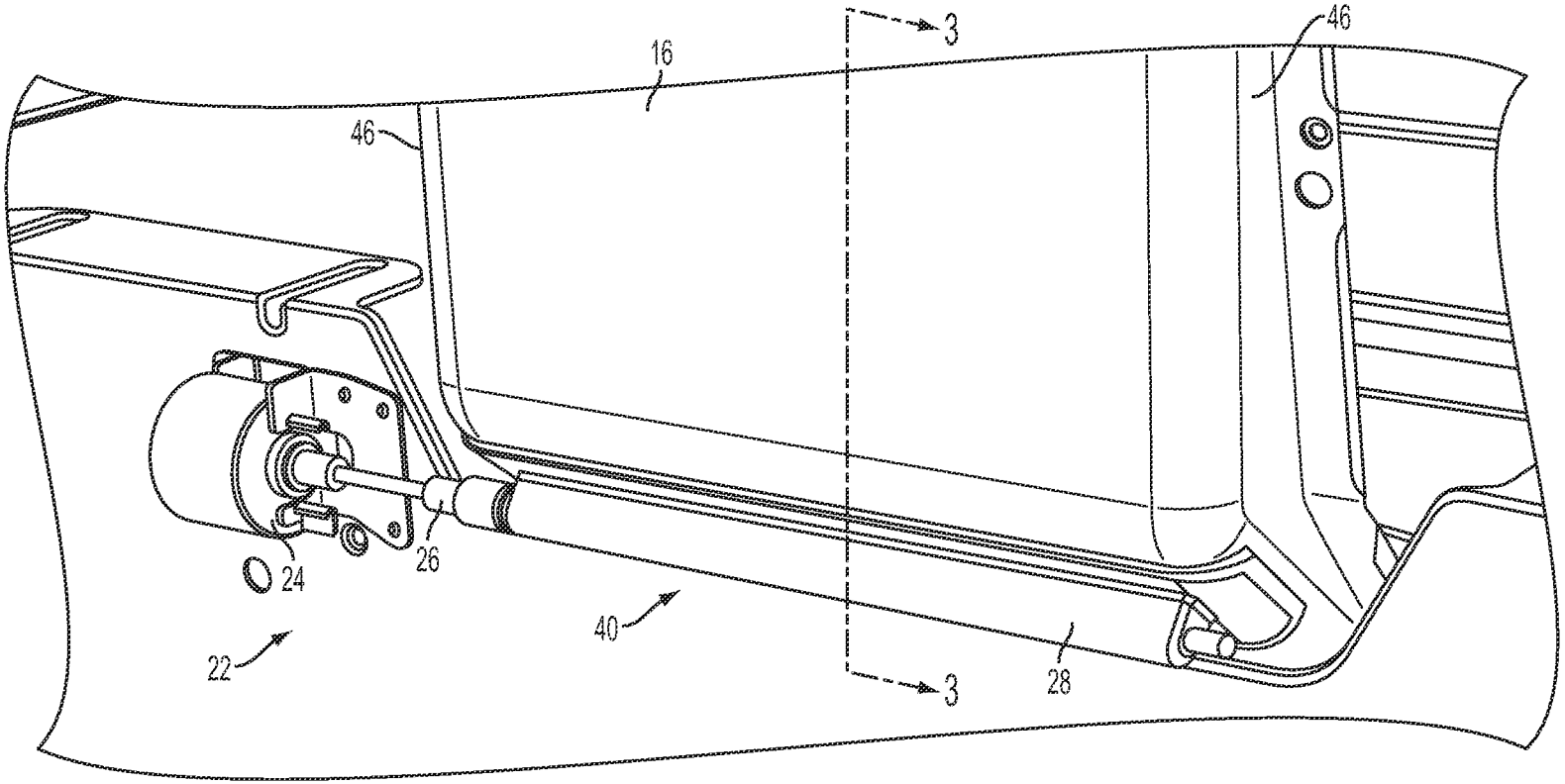
FIG. 2 is a rear perspective view of the outlet duct including a flow control device for controlling a flow of exhaust gas.

Referring now to FIG. 2, the flow control device 22 is shown in attachment with the outlet duct 16. The flow control device 22 can include a number of different structures and configurations suitable to selectively restrict and allow exhaust gas to pass through the outlet duct 16.

The flow control device 22 includes a drive unit 24. The drive unit 24 is shown to be attached to a rear portion of the oven 10. Of course, it is to be understood that the drive unit 24 can be attached at any number of locations, such as to the outlet duct 16, to other surfaces of the oven 10, etc. In one example, the drive unit 24 can include a motor, such as a rotary motor, servomotor, linear motor, etc. However, other types of motors and/or motion producing devices are also envisioned. In the shown example, the drive unit 24 is positioned laterally adjacent the outlet duct 16 and can provide a rotational output.

The flow control device 22 can further include a drive shaft 26. The drive shaft 26 is attached to the drive unit 24, such that the rotational output from the drive unit 24 causes the drive shaft 26 to rotate as well. The drive shaft 26 can include a single piece structure or, in the alternative, can include multiple structures attached together to form the drive shaft 26. The drive shaft 26 extends adjacent an exterior surface of the outlet duct 16 from one side of the outlet duct 16 to an opposing second side of the outlet duct 16. The drive shaft 26 is shown to extend along a generally linear longitudinal axis though, in further examples, the drive shaft 26 could include bends, undulations, turns, or the like. The drive shaft 26 includes a generally circular cross-sectional shape though, in further examples, could have other shapes as well, such as square, rectangular, rounded cross-sections, etc.

The flow control device 22 can further include a support structure 28. The support structure 28 can be attached to an exterior surface of the outlet duct 16 and can provide support to the drive shaft 26. In one example, the support structure 28 can extend along substantially the entire width of the outlet duct 16. However, in further examples, the support structure 28 could extend a longer or shorter distance than as shown. The support structure 28 can define a generally hollow opening that extends longitudinally through the support structure 28 from one end to an opposing second end. In one example, the support structure 28 can have a similar or matching shape as the drive shaft 26, such as by having a generally circular cross-sectional shape that is slightly larger in size (e.g., diameter) than the cross-sectional size of the drive shaft 26. As such, the drive shaft 26 can extend into and through the support structure 28, such that the support structure 28 holds and supports the drive shaft 26. While the support structure 28 can support the drive shaft 26 and maintain a spacing of the drive shaft 26 from the outlet duct 16, the support structure 28 need not hold the drive shaft 26 so tightly so as to limit rotational movement of the drive shaft 26. In particular, the drive shaft 26 can be supported by the support structure 28 while retaining the ability to freely rotate with respect to the relatively stationary support structure 28. In further examples, the support structure 28 can include retaining structures (e.g., ball bearings, gaskets, washers, nuts, etc.) that can assist in allowing the drive shaft 26 to rotate with respect to the support structure 28 while reducing the likelihood of the drive shaft 26 from becoming dislodged from the support structure 28.

Figure 3:
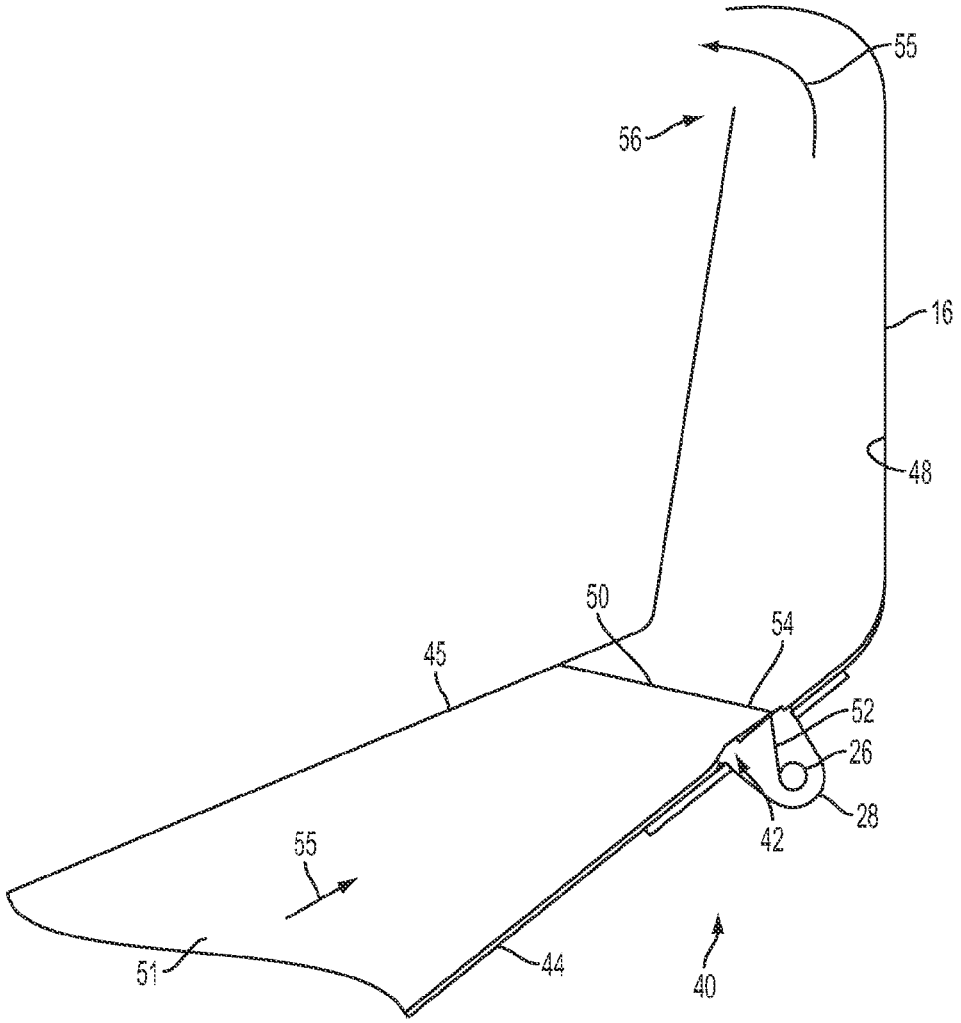
FIG. 3 is a sectional view along line 3-3 of FIG. 2 depicting the flow control device in a closed position within the outlet duct.

Referring now to FIG. 3, a cross-sectional view of the outlet duct 16 is shown along lines 3-3 of FIG. 2. The flow control device 22 can further include a damper assembly 40. The damper assembly 40 can be positioned at least partially within the outlet duct 16 by extending from a location exterior from the outlet duct 16 to an internal passage 48 of the outlet duct 16. In the shown example, the damper assembly 40 can extend through an opening 42 in a first wall of the outlet duct 16. The opening 42 can extend partially or completely across an entire width of the outlet duct 16. In particular, the opening 42 can extend between opposing lateral walls 46 (shown in FIG. 2) of the outlet duct 16. The damper assembly 40 can extend across the internal passage 48 of the outlet duct 16 from the first wall 44 to an opposing second wall 45.

The damper assembly 40 can include a baffle 50 attached to the drive shaft 26. The baffle 50 can be attached in any number of ways to the drive shaft 26, such as with welding, adhesives, or the like. In the shown example, the baffle 50 can be fixedly attached to the drive shaft 26, such that motion from the drive shaft 26 causes motion of the baffle 50. As such, the drive unit 24 is operatively coupled to the damper assembly 40 through the drive shaft 26. In particular, the drive unit 24 is attached to the drive shaft 26, while the drive shaft 26 is attached to the baffle 50 of the damper assembly 40, such that the drive unit 24 and damper assembly 40 are operatively coupled. As the drive shaft 26 rotates, the baffle 50 can likewise rotate in the same direction. The baffle 50 can extend through the opening 42 in the first wall 44. The opening 42 is therefore wide enough to allow the baffle 50 to move freely within the opening 42.

The baffle 50 includes a first portion 52 and a second portion 54. The first portion 52 of the baffle 50 can be attached to the drive shaft 26. As set forth above, the first portion 52 can be attached to the drive shaft 26 in any number of ways, such as through welding, adhesives, or the like. The first portion 52 can extend from the drive shaft 26 at one end, through the opening 42, and into the internal passage 48 at an opposing second end opposite from the first end. The first portion 52 is shown to include a generally linear shape, though in further examples, the first portion 52 could have bends, curves, or the like. Similarly, the first portion 52 can have a larger or smaller cross-sectional width than as shown in FIG. 3, and is not limited to the examples that are shown herein.

The baffle 50 further includes the second portion 54. The second portion 54 is attached adjacent the second end of the first portion 52. It is to be understood that the second portion 54 could be formed as a single structure with the first portion 52, such as by forming a bend in the baffle 50, or the like. In further examples, the second portion 54 could be a separate structure that is attached to the first portion 52, such as by welding, adhesives, mechanical fasteners, etc. In the shown example, the second portion 54 can extend along a different direction than the first portion 52. In particular, the first portion 52 can extend along a first axis while the second portion 4 can extend along a second axis that is non-parallel with the first axis. As with the first portion 52, the second portion 54 can have a larger or smaller cross-sectional width than as shown in FIG. 3, and is not specifically limited to the examples that are shown herein.

It is to be understood that the baffle 50 is not limited to the construction shown and described. Rather, in further examples, the first portion 52 and second portion 54 could be generally parallel with respect to each other, such as by extending along a single axis. In yet another example, the baffle 50 can have more than one bend, and can include a plurality of bends, curves, etc. In yet another example, the baffle 50 is not limited to the specific position with respect to the outlet duct 16, and could be positioned further upstream (i.e., closer towards an inlet 51 of the outlet duct 16) or further downstream (i.e., closer towards an exit opening 56 of the outlet duct 16). As such, the baffle 50 shown herein comprises merely one possible example, as a number of embodiments and constructions are envisioned.

FIG. 3 illustrates the baffle 50 in a closed position. In the closed position, the first portion 52 can extend in a generally vertical direction, while the second portion 54 can extend towards the second wall 45. The second portion 54 can have a length that is sufficient to extend from the first portion 52 to the second wall 45 such that the second portion 54 contacts, or is in close proximity to, the second wall 45. As such, in the closed position, exhaust gas flow (shown generically as arrow 55) is limited from passing by the baffle 50, such that the exhaust gas flow 55 is generally contained upstream from the baffle 50 within the internal passage 48 between the inlet 51 of the outlet duct 16 and the baffle 50. Exhaust gas flow 55 is therefore limited from leaving the outlet duct 16 through the exit opening 56. As shown, the exhaust gas flow 55 can flow in a direction that is substantially transverse to a direction along which the drive shaft 26 extends.

Figure 4:
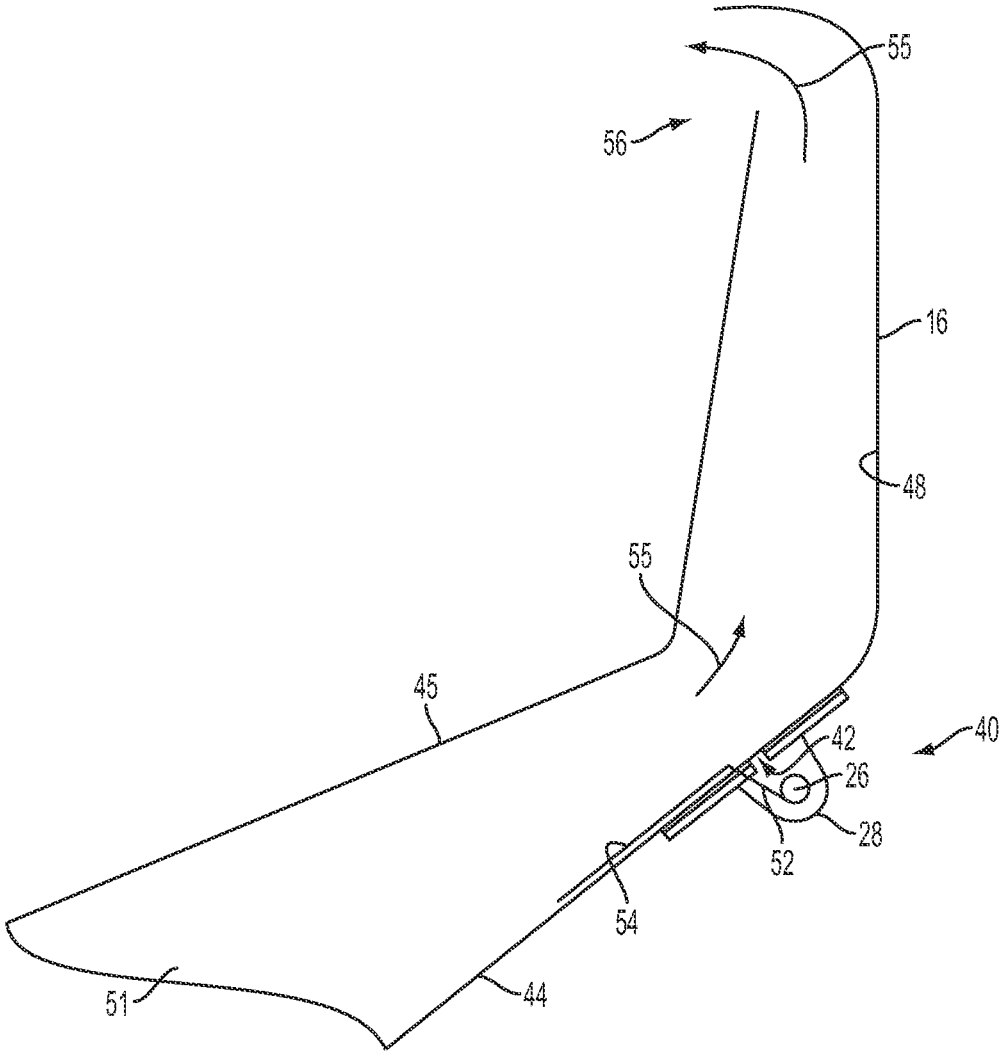
FIG. 4 is a sectional view similar to FIG. 3 depicting the flow control device in an opened position within the outlet duct.

Referring now to FIG. 4, a second cross-sectional view of the outlet duct 16 is shown along lines 3-3 of FIG. 2 with the damper assembly 40 in an opened position. In particular, when the damper assembly 40, including the baffle 50, is in the opened position, the exhaust gas can freely flow through the outlet duct 16 and exit the outlet duct through the exit opening 56. As such, the exhaust gas flow 55 can pass from the oven cavity 12 and through the outlet duct 16. When the baffle 50 is in the opened position, a proper air exchange rate can occur from the oven cavity 12 to maintain combustion limits. To move from the closed position (shown in FIG. 3) to the opened position, the drive shaft 26 can be driven by the drive unit 24 to rotate in a counterclockwise direction. As such, the second portion 54 of the baffle 50 can rotate from contacting the second wall in the closed position, to extending along the first wall 44. In this example, the second portion 54 can extend substantially parallel to and in close proximity with the first wall 44. However, in further examples, the second portion 54 could be spaced a larger distance from the first wall 44 than as shown and need not be flush with the first wall 44. It is further contemplated that the baffle 50 is not limited to being moved to the opened position or the closed position, and that in further examples, the baffle 50 could be partially opened/closed, depending on the desired air exchange rate from the oven cavity 12. In such an example, the second portion 54 can be spaced a distance from each of the first wall 44 and the second wall 45, such that the exhaust gas flow 55 is partially restricted, but can still bypass the baffle 50 and exit the outlet duct 16.

Figure 5:
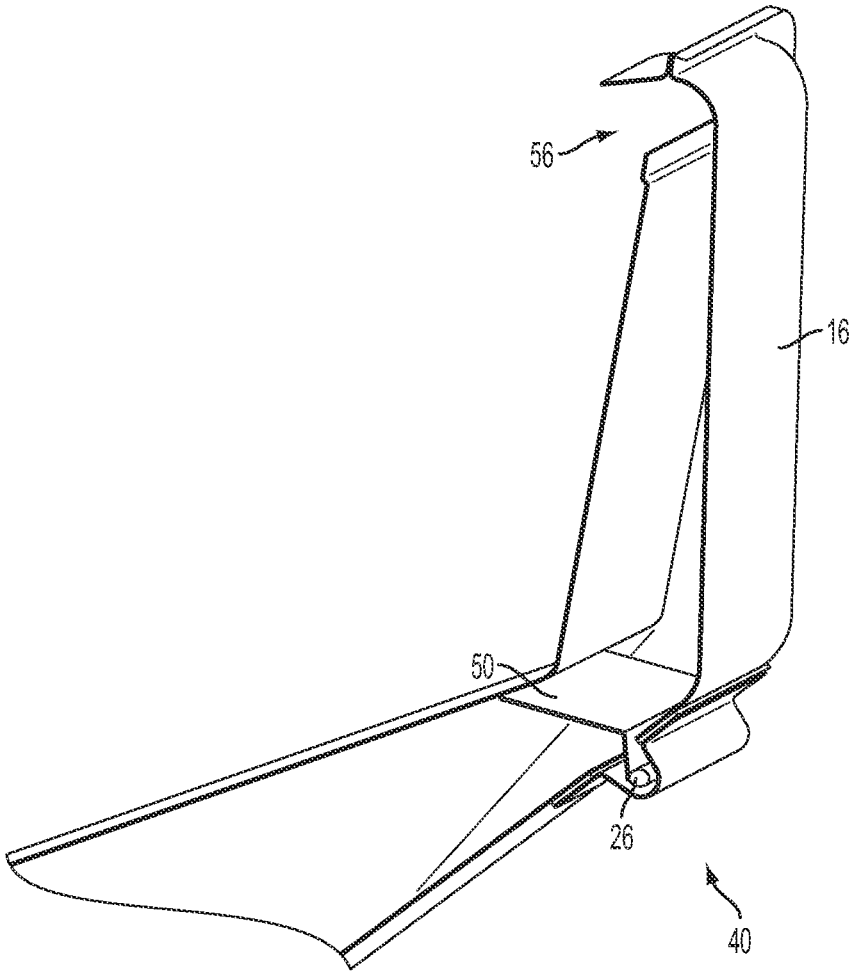
FIG. 5 is a rear perspective view similar to FIGS. 3 and 4 depicting the flow control device extending across the outlet duct.

Referring now to FIG. 5, a rear perspective view of the damper assembly 40 is shown in the closed position. FIG. 5 shows the damper assembly 40 in the closed position in a similar manner as shown in FIG. 3. In this example, it is more clearly seen that the damper assembly 40 extends across the outlet duct 16. As such, the baffle 50 restricts the flow of the exhaust gas through the outlet duct 16 when the baffle 50 is closed.

It is to be appreciated that in further examples, the flow control device 22 can include materials and/or structures that may assist in reducing smoke and odors that pass through the outlet duct 16. In one possible example, to manage exhaust flow, including byproducts of the baking and/or self-clean cycle, through the outlet duct 16, an active catalytic filter can be provided. For instance, the active catalytic filter can be positioned within the outlet duct 16. In the alternative, plasma technology, or the like, could be positioned within the outlet duct 16 to reduce smoke and odors. Indeed, it is to be appreciated that any number of different structures/materials can be provided within the outlet duct 16 to reduce smoke and odors, and are not so limited to the active catalytic filter or plasma technology.

The operation of the flow control device 22 can now be explained. Initially, a user sets a temperature for the oven 10 to reach. The heating assembly 14 turns on and begins during an initial heat up phase. Once the temperature in the oven cavity 12 reaches the pre-set temperature, the initial heat up phase ends and the heating assembly 14 turns off. The heating assembly 14 remains off until the temperature within the oven cavity 12 drops a pre-set amount, such as, for example, 10° F. or 15° F. Once the oven cavity 12 drops to this pre-set temperature, the heating assembly 14 cycles back on, and re-heats the oven cavity 12 to the pre-set temperature. This on/off cycle can continue for as long as a user desires.

To improve efficiency in the oven 10, the flow control device 22 can selectively move between the opened and closed positions based on whether the heating assembly 14 is on or off During the initial heat up phase, the flow control device 22 remains in the opened position (shown in FIG. 4). However, after the oven cavity 12 reaches the pre-set temperature and the heating assembly 14 is turned off, the flow control device 22 moves to the closed position (shown in FIGS. 3 and 5). In this closed position, the second portion 54 of the baffle 50 extends across the internal passage 48 from the first wall 44 towards the second wall 45. Further, the baffle 50 can extend substantially across the entire width of the internal passage 48 between the lateral walls 46. As such, the baffle 50 substantially blocks the exhaust gas flow 55 from passing through the outlet duct 16. The exhaust gas from the oven cavity 12 remains upstream from the baffle 50, either in the oven cavity 12 or in the lower portion of the outlet duct 16 between the inlet 51 and the baffle 50. Heat loss from the oven cavity 12 and through the outlet duct 16 is therefore limited while the heating assembly 14 is turned off.

When the heating assembly 14 is turned on, such as during the initial heat up phase or when cycling on to reheat the oven cavity 12, the flow control device 22 is moved to the open position. In particular, the drive unit 24 causes the drive shaft 26 to rotate in the counter-clockwise direction. The drive shaft 26 continues to rotate counter-clockwise until the baffle 50 reaches the opened position. In the opened position, the second portion 54 of the baffle 50 engages the first wall 44, such as by extending generally parallel with the first wall 44. Accordingly, in the open position, the baffle 50 does not restrict exhaust gas flow 55 from passing through the internal passage 48 of the outlet duct 16 and exiting through the exit opening 56.

Figure 6:
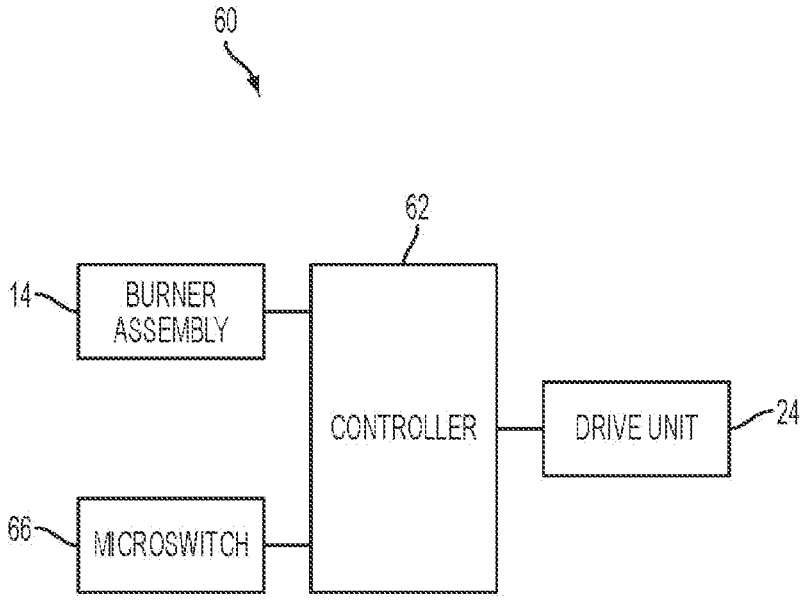
FIG. 6 is a block diagram showing a control system for controlling the flow control device.

Turning now to FIG. 6, the control of the movement of the baffle 50 by the drive unit 24 can now be described. A block diagram is shown of the control system 60 for controlling the drive unit 24. As shown, in one example, the control system 60 can include a controller 62. The controller 62 can be operatively connected to the drive unit 24. The controller 62 can selectively send a signal to the drive unit 24 to cause the drive shaft 26 to rotate. In particular, the controller 62 can send a signal to the drive unit 24 to move the baffle 50 between the opened or the closed positions.

In one example, the controller 62 can be operatively connected to the heating assembly 14. A signal can be sent from the heating assembly 14 to the controller 62, indicating a status of the heating assembly 14 (e.g., turned on or turned off). In this example, when the heating assembly 14 is turned on, the controller 62 can send a signal to the drive unit 24 to move the baffle 50 to the opened position. Conversely, when the heating assembly 14 is turned off, the controller 62 can send a signal to the drive unit 24 to move the baffle 50 to the closed position.

In yet another example, the controller 62 can further be operatively connected to a micro switch 66. The micro switch 66 can include an electric switch that can be actuated by a physical force, such as through a tipping-point mechanism. The micro switch 66 can function as an additional monitoring device (i.e., in addition to the heating assembly 14) that can monitor the state of the heating assembly 14. In one particular example, the micro switch 66 can be actuated during the initial heat up phase of the heating assembly 14. The micro switch 66 can send a signal to the controller 62 to move the baffle 50 to the opened position during this initial heat up phase. As such, the micro switch 66 can ensure that the baffle 50 is in the opened position when the heating assembly 14 is turned on. Of course, in further examples, it is to be understood that the micro switch 66 need not be limited to only the initial heat up phase, and could indicate any time that the heating assembly 14 turns on or off. Further, the micro switch 66 could be triggered in any number of ways. In one possible example, the drive shaft 26 could trigger the micro switch 66, such as by providing a lever, pedal, switch, or the like on the drive shaft 26.

Figure 7:
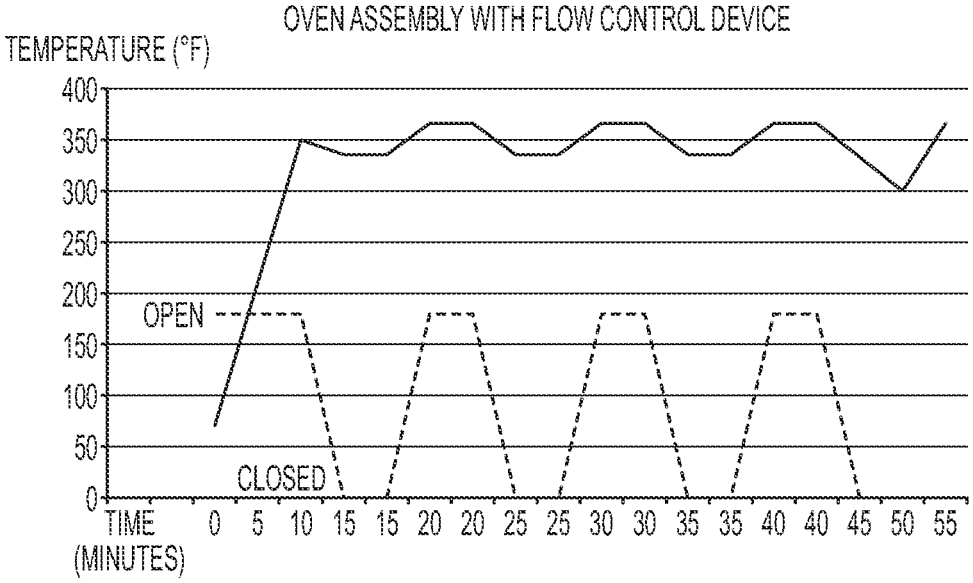
FIG. 7 is a graph showing a temperature within the oven over time with regard to the flow control device being in the opened or closed position.

Turning now to FIG. 7, some of the benefits of the flow control device 22 can now be described. FIG. 7 depicts an X-Y graph in which an oven cavity temperature (in Fahrenheit) is represented by the Y-axis while time (in minutes) is represented by the X-axis. The graph includes two plots. A dashed line plot represents the flow control device 22 being in the opened position or the closed position. The solid line plot represents the oven 10 having the flow control device 22. As shown in the flow control device plot (dashed line plot), it can be seen that the flow control device 22 is selectively moved between the opened position and the closed position. In particular, the baffle 50 is initially in the opened position, and then repeatedly cycles between the opened position, when the heating assembly 14 is on, and the closed position, when the heating assembly 14 is off. The temperature within the oven cavity 12 is shown (solid line plot) corresponding to the flow control device plot. As shown, the temperature within the oven cavity 12 remains relatively constant even when the heating assembly 14 is off and the flow control device 22 is closed. In particular, the temperature within the oven cavity 12 dips slightly below 350° F. when the heating assembly 14 is off and the baffle 50 is closed. Similarly, the temperature within the oven cavity 12 rises slightly above 350° F. when the heating assembly 14 is on and the baffle 50 is opened. As such, by providing the flow control device 22 in the oven 10, the oven 10 can experience a more uniform temperature within the oven cavity 12. Further, heat loss is reduced while efficiency is improved, as the oven cavity 12 does not undergo large temperature fluctuations. In one example, a 26% improvement in efficiency was shown in an oven 10 having the flow control device 22 as compared to an oven without the flow control device.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An oven, including:

an oven cavity;

an outlet duct in fluid communication with the oven cavity, the outlet duct including an internal passage extending continuously from the oven cavity at an upstream inlet of the outlet duct to a downstream exit opening of the outlet duct; and a flow control device coupled to the outlet duct, the flow control device including:

a drive unit located at the exterior of the outlet duct;

a drive shaft located entirely adjacent an exterior surface of the outlet duct and outside the internal passage of the outlet duct extending from one side of the outlet duct to an opposing second side of the outlet duct and attached to the drive unit for rotation by the drive unit;

a damper assembly comprising a baffle that extends from the drive shaft through an opening in a first wall of the outlet duct and into the internal passage of the outlet duct, the baffle including a baffle first portion positioned at least in part at an exterior of the first wall of the outlet duct and a baffle second portion configured to open and close the internal passage of the outlet duct, the baffle second portion being fixedly joined to an end of the baffle first portion and located within the internal passage of the outlet duct both when opening and when closing the internal passage of the outlet duct, the baffle first portion being operatively coupled to the drive shaft for rotation with the drive shaft, whereby rotation of the drive shaft selectively moves the baffle second portion between a closed position in which exhaust gas is generally blocked from flowing through the internal passage of the outlet duct and an opened position in which exhaust gas is not generally blocked from flowing through the internal passage of the outlet duct; and a controller operatively connected to the drive unit, the controller being configured to send a signal to the drive unit to move the baffle of the damper assembly between the opened position and the closed position.

2. The oven of claim 1, wherein the drive shaft extends from the drive unit in a direction transverse to a direction of the exhaust gas flow.

3. The oven of claim 2, wherein the outlet duct includes opposing lateral walls and the baffle second portion extends in a direction substantially transverse to the exhaust gas flow such that the baffle second portion extends between opposing lateral walls of the outlet duct within the internal passage.

4. The oven of claim 3, wherein in the opened position, the entirety of the baffle second portion is positioned adjacent the first wall of the outlet duct and extends in a direction that is substantially parallel to the first wall.

5. The oven of claim 4, wherein in the closed position, the baffle second portion extends across the internal passage from the first wall of the outlet duct and contacts a second wall of the outlet duct that is positioned opposite from the first wall of the outlet duct.

6. The oven of claim 1, further including a micro switch configured to detect whether the heating assembly is turned on or off.

7. The oven of claim 6, wherein the micro switch is configured in response to detecting whether the heating assembly is turned on or off to selectively send a signal to the controller to move the baffle of the damper assembly between the opened position and closed position.

8. A baking oven, including:

an oven cavity including a heating assembly configured to be turned off and turned on and to heat the oven cavity by heating the oven cavity to a pre-set cooking temperature during an initial heat up phase while turned on and thereafter substantially maintaining the oven cavity temperature relatively constant by being alternately turned on and turned off;

an outlet duct in fluid communication with the oven cavity, the outlet duct being configured to receive exhaust gas from the oven cavity; and a flow control device attached to the outlet duct, the flow control device including:

a drive unit located at the exterior of the outlet duct;

a drive shaft located entirely adjacent an exterior surface of the outlet duct and outside the internal passage of the outlet duct from one side of the outlet duct to an opposing second side of the outlet duct and attached to the drive unit for rotation by the drive unit;

a damper assembly comprising a baffle that extends from the drive shaft through an opening in a first wall of the outlet duct and into the internal passage of the outlet duct, the baffle including a baffle first portion positioned at least in part at an exterior of the first wall of the outlet duct and a baffle second portion configured to open and close the internal passage of the outlet duct, the baffle second portion being fixedly joined to an end of the baffle first portion and located within the internal passage of the outlet duct both when opening and when closing the internal passage of the outlet duct, the baffle first portion being operatively coupled to the drive shaft for rotation with the drive shaft; and a control system operatively associated with both the heating assembly and the damper assembly and configured to send signals to the damper assembly to move the damper assembly to the opened position when the heating assembly is turned on during the initial heat up phase and thereafter while the temperature of the oven cavity is maintained relatively constant, the control system being further configured to send signals to the damper assembly to move the damper assembly to the closed position when the heating assembly is turned off while the temperature of the oven cavity is maintained relatively constant.

9. The oven of claim 8, wherein when the heating assembly is turned off, exhaust air is limited from exiting through the outlet duct.

10. The oven of claim 9, wherein in the opened position, the baffle is positioned adjacent the first wall and extends in a direction that is substantially parallel to the first wall.

11. The oven of claim 10, wherein in the closed position, the baffle extends across the internal passage and contacts a second wall that is positioned opposite from the first wall.

12. The oven of claim 8, further including a micro switch, the micro switch being configured to separately detect whether the heating assembly is turned on or off and to ensure that the damper assembly is in the open position when the heating assembly is turned on during the initial heat up phase.

* * * * *